United States Patent [19]

Mullany

[11] 4,405,130

[45] Sep. 20, 1983

[54] LOCATION INDICATOR FOR USE IN BASEBALL AND SIMILAR GAMES

[76] Inventor: David A. Mullany, 275 Bridgeport Ave., Shelton, Conn. 06484

[21] Appl. No.: 256,706

[22] Filed: Apr. 23, 1981

[51] Int. Cl.[3] ..... A63B 71/02

[52] U.S. Cl. ..... 273/25

[58] Field of Search ..... 273/25

[56] References Cited

U.S. PATENT DOCUMENTS 2,138,273 11/1938 Goodrick ..... 273/25

3,695,610 10/1972 Thompson ..... 273/127 D 3,971,558 7/1976 Gardetto ..... 273/25

*Primary Examiner*—Anton O. Oechsle

[57] ABSTRACT

Location markers for games such as baseball designating the locations of "home plate", the "pitcher's rubber" and "bases" comprising a plate having a top surface and an underside; holding clips extending below the underside of said plate; comprising a slotted finger having an upper arc; a ground anchor comprising two prongs joined by a connecting rod removably carried by said clip and adapted to be inserted into the ground to maintain the marker in position.

9 Claims, 5 Drawing Figures

LOCATION INDICATOR FOR USE IN BASEBALL AND SIMILAR GAMES

THE BACKGROUND OF THE INVENTION

The present invention relates to a device which may be used in baseball and similar games as the location marker for "home plate", the "pitching rubber" or as any "base".

Heretofore, such location indicators were, for the most part, provided in the form of a canvas bag or the like, filled with a substance such as sand to maintain them in position. Many difficulties involving storage and securement have been encountered with the use of such devices.

An attempt to solve these problems is found in U.S. Pat. No. 3,971,558 which provides a base marker comprising a flat plate with a central opening or recess. A "plug" is removable disposed in the opening and two spikes of unequal length are carried by the plug. This structure, however, is highly complex despite its outward appearance of simplicity. For example, in order to store the base it is necessary to remove the spikes from the plug and place them in clips disposed at a position remote from the opening. The plug is then reinserted in the opening. To reassemble it, it is necessary to remove the plug from the plate, remove the spikes from the clips, assemble the spikes in the plug and reinsert the plug carrying the spikes in the recess.

The base marker is not completely satisfactory because of the possibilities of loss or damage to the individual parts during dismantling, storage and assembly.

The present invention addresses and solves these problems with a simple, inexpensive and easy to operate device.

SUMMARY OF THE PRESENT INVENTION

It is the object of the present invention to present a unitary substantially integral device for use as the "home plate", "pitching rubber" and "base" in a baseball or similar game. The structure of the invention comprises a relatively flat plate having a depending flange extending substantially about its entire perimeter. The flange provides a side wall around the base of the plate. The plate is preferably plastic although any suitable material may be utilized. A plurality of holding clips are disposed on the underside of the plate being preferably molded therewith. A two-pronged substantially U shaped ground anchor is mounted on the underside of the plate. The two prongs are connected by an intermediate member which is carried by the clips. The intermediate member may be rotatably mounted. The prongs of the ground anchor are adapted to extend from the underside of the plate for securement in the ground. The ground anchor is easily removable from the clip or it may be moved into a flat collapsed position on the underside of the plate within the confines of the peripheral flange for ease of shipment and storage.

The plate section of the present invention may be constructed in a variety of shapes such as the shape of a "home plate", a "pitcher's rubber" or a conventional "base" while nevertheless incorporating the features of the present invention.

Herein the unit will be designated as a "ground-anchored base" although it will be understood that this designation is intended to cover "home plates" and "pitching rubbers" as well as "bases".

DETAILED DESCRIPTION OF THE PREFERRED EMBODIMENT

Referring specifically to the drawings there is shown the ground-anchored base 10 which comprises a relatively flat plate 11 having a top surface and a bottom surface which comprises a recessed underside 12. The base is preferably made of durable, sturdy plastic material although, of course, any suitable material such as wood or the like may be utilized.

The recess in the underside 12 of the base is formed by a peripheral flange 13 which is integral with the plate 11. When the base is made of plastic, the peripheral flange 13 is provided in the molding operation.

Figure 1:
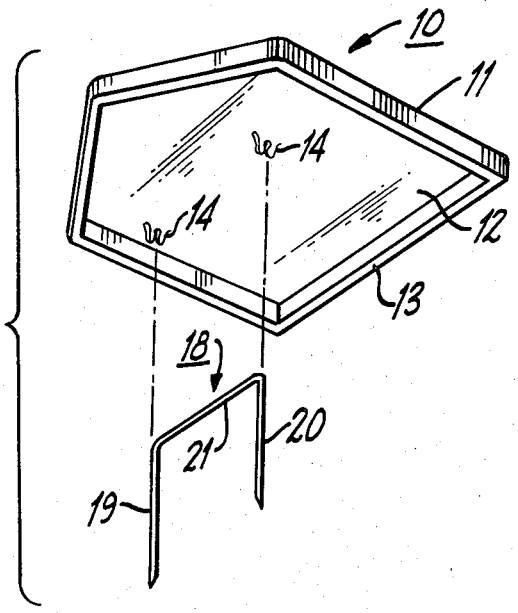
FIG. 1 is a perspective view of the underside of the ground-anchored base in the form of a "home plate" with the two-pronged anchor separated from the base.
Figure 2:
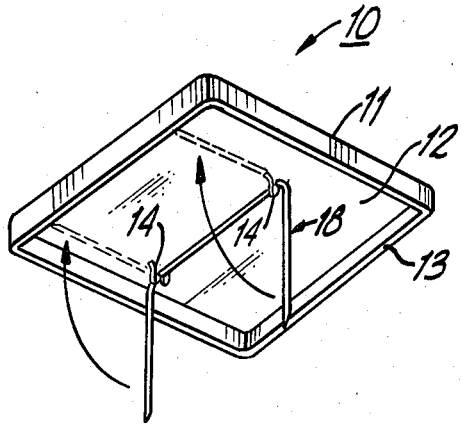
FIG. 2 is a perspective view of the underside of the ground-anchored base in the form of a "base" and showing in dotted lines the storage and shipping position of the two-pronged anchor.
Figure 3:
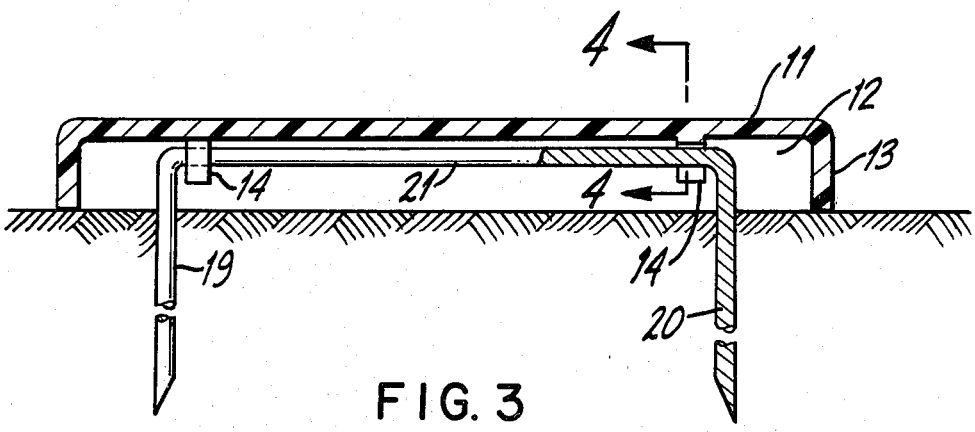
FIG. 3 is a sectional view of the ground-anchored base of the present invention.
Figure 5:
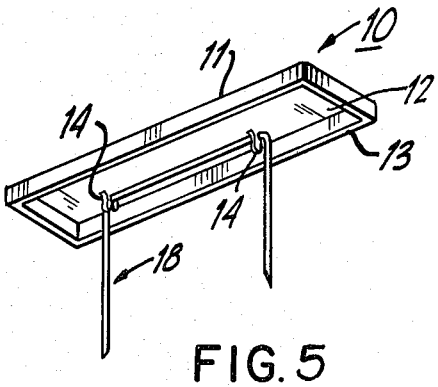
FIG. 5 is a perspective view of the underside of the ground-anchored base in the form of a "pitcher's rubber".

As illustrated, the base may be constructed in a variety of shapes. For example, FIG. 1 shows a "home plate", FIG. 2 shows a "base" and FIG. 5 shows a "pitcher's rubber". All are provided with a peripheral flange 13 conforming to the desired shape.

A pair of clips 14 extend from the underside 12 of the ground-anchored base. The clips 14 have a slotted portion 15 at the lower extremity and a substantially circular channel 16 at the upper portion of each clip.

The clips 14 are preferably molded together and integral with the base itself. The clip 14 is constructed of two fingers 17 and 18 having an arc formed from a flexible and resilient material. While two clips are illustrated, it will be understood that one elongate clip of substantially the same cross-sectional configuration may be utilized to accomplish the desired result as herewith set forth.

Figure 4:
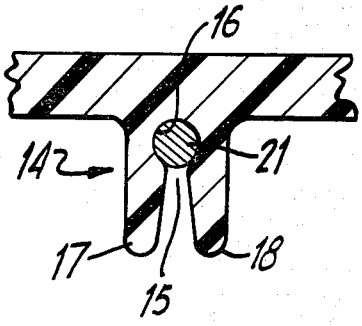
FIG. 4 is a sectional view taken along the lines 4—4 of FIG. 3.

A ground anchor 18 having two extending prongs 19 and 20 and an intermediate connecting rod 21 is also provided. The ground anchor 18 is substantially U-shaped and preferably constructed of metal although any other suitably sturdy and durable material may be used. The intermediate rod 21 of the ground anchor 18 is so constructed as to enable it to snap into and be rotatably held by the clip in the manner clearly illustrated in FIG. 4.

The prongs 19 and 20 of the ground anchor 18 are readily insertable into the ground and to maintain the base above them in the desired position on the field. The construction is such that when the base is contacted during use, as for example by sliding players, the base does not move out of position in any way since the ground anchor and clip or clips inherently fix the plate against relative, e.g. rotational, movement within the plane of the plate when the prongs are inserted into the ground. Thus, fidelity to the dimensions of areas in the playing field is established and maintained.

The ground anchor is easily attached to the base by means of its engagement with the clips 14. This engagement is accomplished simply by forcing the rod portion 21 of the anchor 18 through the slot 15 formed by the resilient fingers 17 and 18 and into the channel 16 where it is resiliently locked in position. The ground anchor may be removed by forcing it out of the channel or it may be moved in the direction of the arms in FIG. 2 to about the underside 12 of the base. This arrangement is beneficial for shipment and storage purposes as the anchor may be disposed in the recessed portion in the underside of the base.

As illustrated, the prongs of the ground anchors are of equal length, insuring the maintenance of the base on a level plane no matter which side of the base is forcibly contacted by the player.

Thus there has been presented an inexpensive, easy to operate structure for a ground-anchored base which is durable and dependable.

While the invention has been described in detail in connection with an embodiment thereby, such description is merely for illustration purposes. Variations and modifications of the invention may be made without departing from the spirit of the invention as set forth in the appended claims.

I claim:

1. A ground anchored base for baseball or the like comprising:

a plate extending in a plane and having a top surface and an underside, a ground anchor having prongs arranged for anchoring insertion into the ground and which are integrally interconnected by an intermediate rod providing an engagement between said ground anchor and said plate, and means fixedly connected to the plate for snap lockingly resiliently connecting the intermediate rod of the ground anchor to the plate in spaced relation to the underside of the plate for fixing the plate against relative movement within its said plane when the prongs are inserted into the ground.

2. The base of claim 1 in which said means for connecting the ground anchor to the underside of the plate comprises a clip.

3. The base of claim 2 in which the ground anchor is rotatably mounted in said clip for relative movement about an axis extending generally parallel to the plane of the plate.

4. The base of claim 3 including a flange depending from a portion of and in proximity to the perimeter of said plate.

5. The base of claim 3 in which the clip comprises a slotted resilient finger and a channel above said slotted finger for carrying the intermediate rod.

6. The base of claim 5 including a flange depending from and in proximity to the perimeter of said plate and extending around the entire perimeter of said plate.

7. The base of claim 6 in which said clip is detachable.

8. The base of claim 6 in which the ground anchor is rotatably mounted in said clip for movement between an anchoring position and a collapsed position abutting the underside of said plate, and the flange extends below the ground anchor when said anchor is in a collapsed position abutting the underside of the plate.

9. A ground anchored base for baseball and the like comprising:

a plate extending in a plane and having top and bottom surfaces, an integral flange depending from said plate around its perimeter, a spaced pair of separate resilient clips individually fixedly connected to and depending from the bottom surface of said plate and comprising slotted fingers having downwardly facing slots and channels inwardly above said slots and communicating therewith, and a separate ground anchor having spaced prongs of equal length provided with bottom portions for anchoring insertion into the ground and with top protions which are integrally interconnected by an intermediate rod, said rod being snap lockingly resiliently engageable within the channels in said clips in spaced relation to the bottom surface of said plate and at correspondingly spaced engagement portions on the rod adjacent the top portions of said prongs and such that the relative positions of the clips and prong top portions at such engagement portions of the rod generally prevent relative movement between the rod and clips in a directly axially along the rod, for maintaining said anchor in position and for fixing the plate against relative movement within its said plane when the prongs are inserted into the ground.

* * * * *